United States Patent [19]

Burrows

[11] 4,106,706

[45] Aug. 15, 1978

[54] ROTARY TUB GRINDER

[76] Inventor: Harvey Paul Burrows, 1633 26th Ave. Ct., Greeley, Colo. 80631

[21] Appl. No.: 820,441

[22] Filed: Aug. 1, 1977

[51] Int. Cl.[2] ..... B02C 13/06; B02C 13/286

[52] U.S. Cl. ..... 241/186.2; 241/101.7; 241/186.4; 241/189 R; 241/240

[58] Field of Search ..... 241/101.7, 186 R, 186.2, 241/186.4, 189 R, 189 A, 190, 239–241

[56] References Cited

U.S. PATENT DOCUMENTS

| | | | |
|---|---|---|---|
| 1,355,093 | 10/1920 | Herche | 241/240 |
| 1,420,021 | 6/1922 | Davidson | 241/240 X |
| 2,216,612 | 10/1940 | Dimm et al. | 241/241 X |
| 3,490,705 | 1/1970 | Ruckstuhl | 214/186 R |
| 3,966,128 | 6/1976 | Anderson et al. | 241/186.2 X |
| 4,003,502 | 1/1977 | Barcell | 241/101.7 X |
| 4,033,515 | 7/1977 | Barcell et al. | 241/189 R X |
| 4,066,216 | 1/1978 | Waldrop et al. | 241/101.7 X |

FOREIGN PATENT DOCUMENTS

| | | | |
|---|---|---|---|
| 2,420,138 | 11/1975 | Fed. Rep. of Germany | 241/186 R |
| 495,085 | 4/1976 | U.S.S.R. | 241/186 R |

*Primary Examiner*—Howard N. Goldberg
*Attorney, Agent, or Firm*—Burton & Dorr

[57] ABSTRACT

A rotary tub grinder in which a substantially cylindrical tub member is rotated relative to a stationary floor member. Material in the tub grinder is moved over the upper surface of the floor member and a portion of it is moved up a ramp into the path of a rotating hammermill. A stabilizer member is positioned on the floor member across the opening from the ramp member and serves to steady the material so that the hammers of the hammermill can uniformly feed material downwardly into the grinder. The stabilizer member extends higher above the floor member than the ramp member and the path of the rotating hammers extends higher above the floor member than the stabilizer member. A layer of material is planed off as it moves about the tub grinder. The ramp member and stabilizer member also serve to help prevent material from falling into and clogging the grinder when the tub grinder is shut down or slowed down by a power governor. The grinder of the present invention includes a plurality of shear plates that are mounted to a wall of a casing that surrounds the rotating hammers. The shear plates are adjustable toward and away from the path of the rotating hammers so that the size of the grind can be adjusted. In one embodiment, the shear plates are mounted on a support member which is adjustable relative to the wall member of the casing and to the axis of rotation of the hammers. The invention further includes a flap valve arrangement for selectively controlling the amount of air that is discharged with the material that leaves the casing through the material outlet. Several embodiments of the stabilizing means are disclosed including a hood-shaped stabilizing member, a stabilizer means composed of a plurality of strips, and a stabilizing means in which the stabilizer member has a shape substantially the same as the ramp member so that the tub grinder could be efficiently run with the tub member rotating in either direction about its axis.

48 Claims, 11 Drawing Figures

Fig.-II

Fig.-4
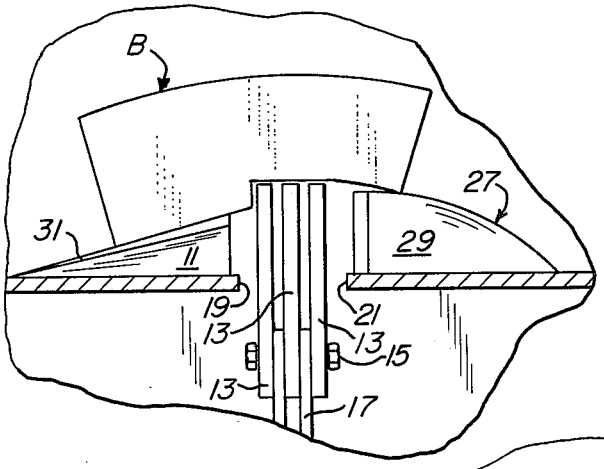
Fig.-6
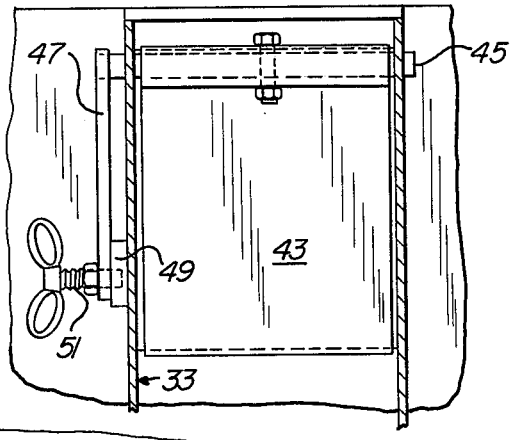
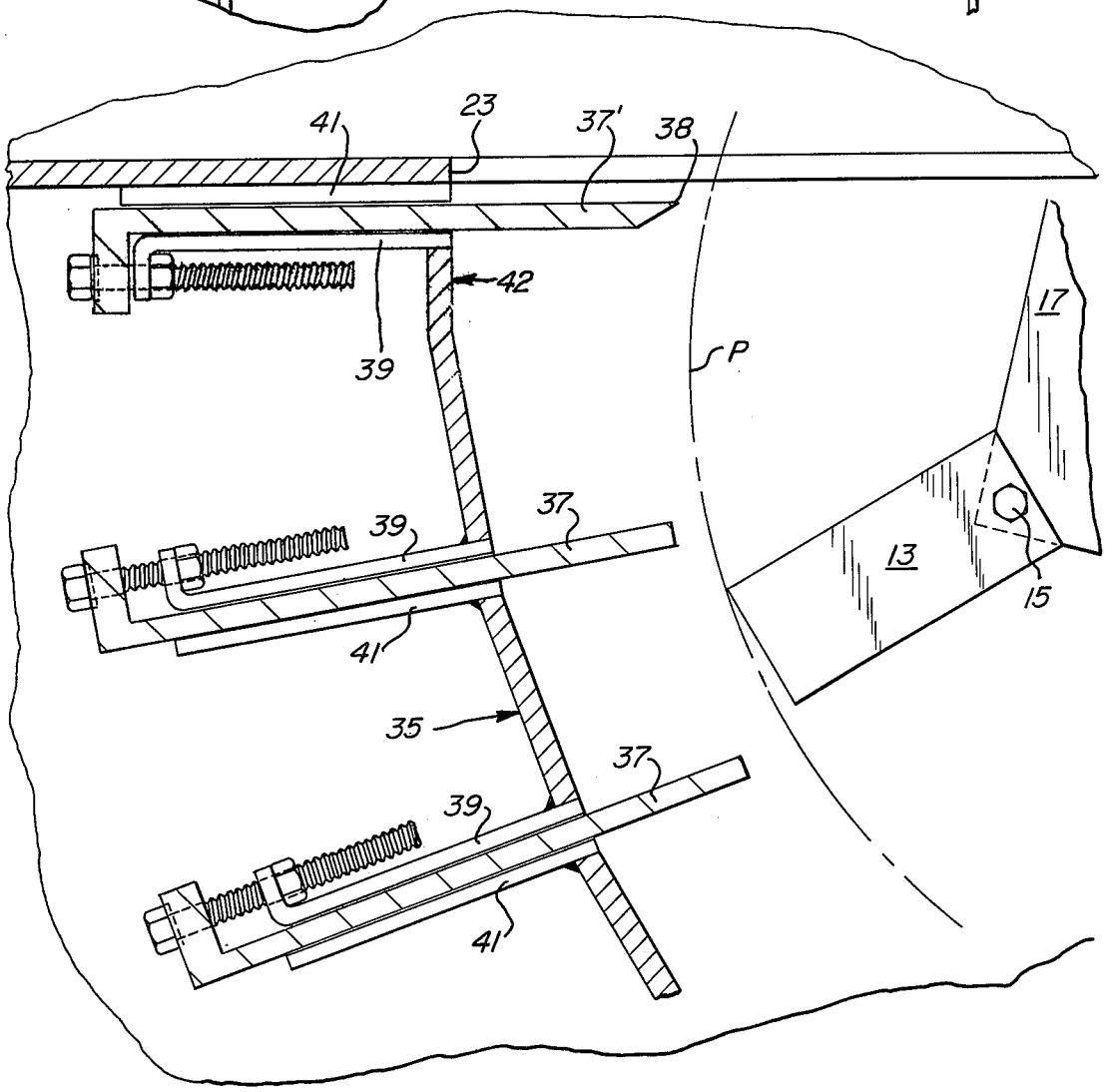
Fig.-5

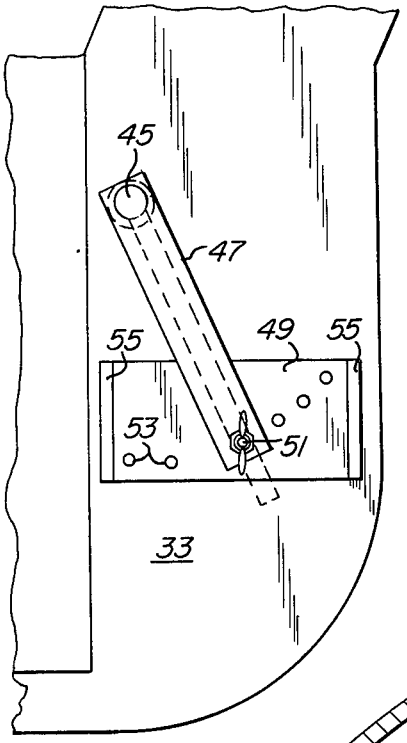
Fig.-7
Fig.-8
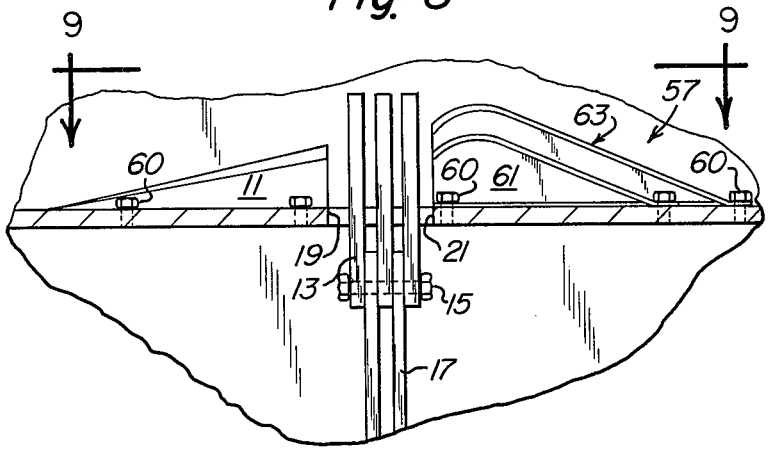
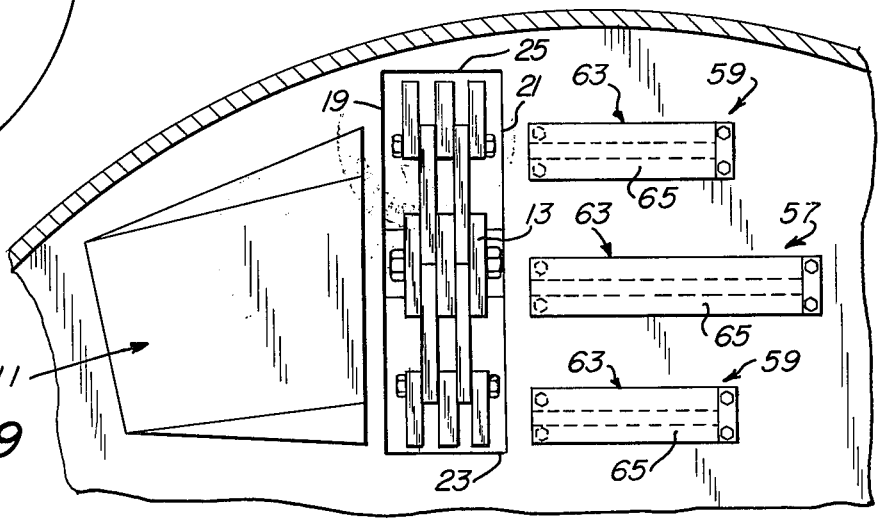
Fig.-9
Fig.-10
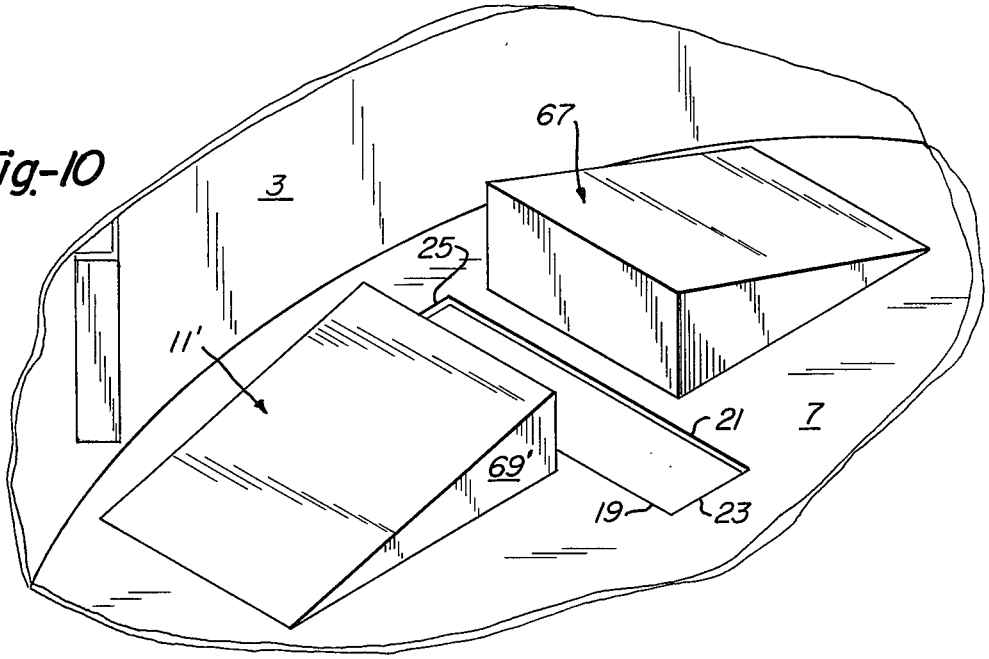

ROTARY TUB GRINDER

FIELD OF THE INVENTION

This invention relates to the field of grinders and more particularly to the field of tub grinders for grinding roughages and grains.

BACKGROUND OF THE INVENTION AND PRIOR ART

Tub grinders are widely used in agriculture to grind roughages and grains. Most prior tub grinders have a stationary floor member about which a cylindrical tub member is rotated. The material is moved over the upper surface of the stationary floor member and into the path of a rotating hammermill or other grinding apparatus. A portion of the rotating hammermill extends above the upper surface of the stationary floor member through an opening therein and the material is fed into the hammermill in a direction substantially perpendicular to the axis of rotation of the hammermill. Examples of such prior tub grinders include U.S. Pat. No. 4,003,502 to Barcell issued on Jan. 18, 1977, and U.S. Pat. No. 2,650,745 to Oberwortman issued on Sept. 1, 1953. In U.S. Pat. No. 3,615,059 to Moeller issued on Oct. 26, 1971, the tub member 12 is oscillated about an axis to advance the material toward the opening 44. U.S. Pat. No. 3,483,906 to Moeller issued on Dec. 16, 1969, also oscillates the tub member 16 relative to the floor member to advance the material. In this patent, a cover member 58 is provided in FIG. 4 which can be used as a valve to adjust the size of the opening 62 above the grinder 28. Other grinders and apparatuses in this general field include U.S. Pat. No. 3,550,661 to Moeller issued on Dec. 29, 1970, U.S. Pat. No. 3,861,601 to Kaelin issued on Jan. 21, 1975, U.S. Pat. No. 3,556,605 to Berg issued on Jan. 19, 1971, and U.S. Pat. No. 2,839,250 to Brockman issued on June 17, 1958.

All known prior art tub grinders have major problems in delivering material from the floor member downwardly into the grinder at a uniform rate. They also have serious problems with material falling down into the casing of the grinder or coming to rest on top of the grinder elements when the tub grinder is shut down or slowed down by a power governor. The material falling into the casing by gravity or resting atop the grinding elements makes it extremely difficult to restart the tub grinder or bring the rotating grinder back up to peak speed after a slowdown. The problems of uniform feed and material clogging the casing during a shutdown or slowdown are particularly acute if the material is wet.

Past tub grinders have further problems with versatility in that they cannot be easily and quickly adapted to handle different materials and material in different degrees of compactness as for example from bales to loose stack and from wet to dry. The grinding apparatus or hammermill of prior tub grinders also lack versatility in that they cannot be easily and quickly adapted to adjust the grind size of the ground material for any given material or for a different material that may be placed in the tub grinder. Control of the amount of air and material leaving the casing after being ground has also been a problem area in past tub grinders.

The ideal tub grinder would be durable, simple in design, able to uniformly feed material into the grinder, versatile, and easy to restart after being shut down or slowed down by a power governor. For versatility, the ideal tub grinder would be easily and quickly adaptable to handle a wide variety of materials in various degrees of compactness and wetness as well as easily and quickly adaptable to adjust the grind size of the material. The present invention offers such a tub grinder.

SUMMARY OF THE INVENTION

The present invention involves a tub grinder which has a stationary floor member about which a tub member is rotated. Material placed in the tub grinder is moved over the upper surface of the floor member and a part of the material is moved up a ramp member into the path of rotating hammers. The hammers are part of the grinding apparatus or hammermill and are rotated about an axis located below the floor member. The hammers are rotated about a closed path with a portion of the closed path extending through an opening in the floor member and above the upper surface thereof. A stabilizer member is positioned on the floor member across the opening from the ramp member and serves to steady the materials so that the hammers can uniformly feed material downwardly into the grinder. The stabilizer member extends higher above the floor member than the ramp member and the path of the hammers extends higher above the floor member than the stabilizer member. In this manner, a layer of material is planed off as it moves about the tub grinder. The ramp member and stabilizer member also serve to help prevent material from falling into and clogging the grinder when the tub grinder is shut down or slowed down by a power governor. The relative sizes of the ramp member and stabilizer member can be varied as desired according to the properties of the material being ground.

The rotating hammers move the materials down through the opening in the floor member and past shear plates where they are ground. Each shear plate is flat and mounted for movement in a plane. A plurality of the shear plates are mounted for movement in planes that intersect the axis of rotation of the grinder. The top shear plate is positioned adjacent the opening in the floor member and is movable in a horizontal plane to control the amount of material entering into the grinder. In one embodiment, the shear plates are mounted on a support member which is movable toward and away from a wall member of the casing and the axis of rotation of the grinder. This wall member can be moved as a unit or each end of it can be individually moved relative to the other end for fine adjustments. A flap valve is also provided for controlling the amount of air that is discharged with the material leaving the casing through the material outlet.

Several embodiments of the stabilizing means are disclosed. In one embodiment, the stabilizer means is a hoodshaped member. In another embodiment, the stabilizer means is a plurality of strips which are positioned opposite the opening in the floor member from the ramp member. In a third embodiment, the stabilizer means and the ramp member have substantially the same shape with the stabilizer member extending above the floor member of the tub grinder for a greater distance. In all of the preferred embodiments, the ramp member and the stabilizer member are positioned on opposite sides of the opening through the floor member and the material is fed in a direction substantially parallel to the axis of rotation of the grinder.

OBJECTS OF THE INVENTION

It is an object of this invention to provide a new and novel tub grinder that is durable, simple in design, and versatile.

It is also an object of this invention to provide a new and novel tub grinder that can feed material into the grinder at a uniform rate.

Another object of this invention is to provide a new and novel tub grinder which has an arrangement for stabilizing the material in the vicinity of the path of the rotating grinding elements so that a uniform layer of material can be planed off.

It is an object of this invention to provide a new and novel tub grinder in which the amount of material fed into the grinder can be easily and quickly adjusted by substituting differently sized ramp members and stabilizer members on the floor of the tub grinder adjacent the opening therein.

Another object is to provide a new and novel tub grinder that is easy to restart after a shutdown or slowdown by a power governor.

Another object of this invention is to provide a new and novel tub grinder that substantially prevents material from falling into and clogging the grinder during a shutdown or slowdown by a power governor.

It is an object of this invention to provide a new and novel tub grinder that can be easily and quickly adapted to handle a wide variety of materials in various degrees of compactness and wetness.

Another object is to provide a new and novel tub grinder with a valve arrangement that can easily and quickly control the amount of air and material that is leaving the grinder through the material outlet of the grinder.

Another object is to provide a new and novel tub grinder that can be easily and quickly adapted to adjust the grind size of the material.

Another object is to provide a new and novel tub grinder which has shear plates that can be moved toward or away from the path of the rotating grinding elements.

It is an object to provide a new and novel tub grinder in which the shear plates are mounted in a support member which can be moved toward or away from the axis of rotation of the grinder in order to adjust the size of the grind.

Additional objects as well as features and advantages of this invention will become evident from the descriptions set forth hereinafter when considered in conjunction with the accompanying drawings.

BRIEF DESCRIPTION OF THE FIGURES

FIG. 4 is a view along line 4—4 of FIG. 3 illustrating the manner in which material is planed off by the arrangement of the ramp member, stabilizer member, and rotating hammermill.

FIG. 5 is an enlarged view of the shear plates which are mounted to a wall of the casing which encloses the hammermill. The shear plates are movable relative to the wall member toward and away from the path of the rotating hammers of the hammermill.

FIG. 6 is a view along line 6—6 of FIG. 2 illustrating the manner in which the flap valve is mounted at the material outlet in the casing.

FIG. 7 is a side view of FIG. 6 illustrating the manner in which the flap valve can be selectively locked in a position to control the amount of air that is discharged with the material that leaves the casing through the material outlet.

FIG. 8 is a view similar to FIG. 4 illustrating a modification of the stabilizer means. In this embodiment, the stabilizer means consists of narrow strips that are spaced from each other.

FIG. 9 is a view along line 9—9 of FIG. 8 further illustrating the modified stabilizer means.

FIG. 10 illustrates a third embodiment in which the stabilizer means is substantially the same shape as the ramp member. In this embodiment, the stabilizer member extends slightly higher above the upper surface of the floor member of the tub grinder. The substantial similarity between the ramp member and the stabilizer member of this embodiment enables the tub grinder to be rotated in either direction without a great loss in the efficiency of the tub grinder.

FIG. 11 illustrates a modification where the support member on which the shear plates are mounted is movable toward and away from the wall member of the casing and the axis of rotation of the grinder. In this modification, the upper and lower ends of the wall member can also be moved relative to each other. In this manner, the size of the grind and the manner in which the material is ground can be adjusted as desired.

DETAILED DESCRIPTION OF THE PREFERRED EMBODIMENTS

Figure 1:
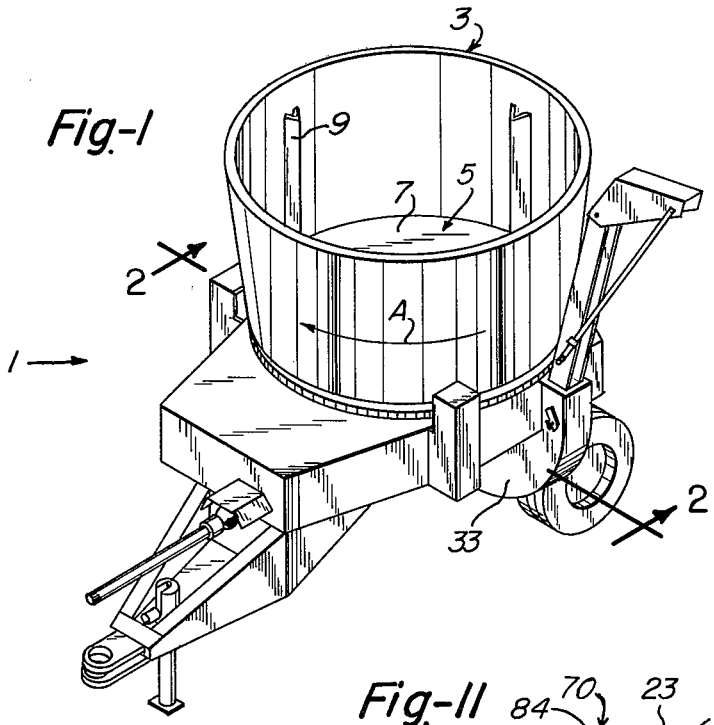
FIG. 1 is a perspective view of the tub grinder of the present invention.
Figure 2:
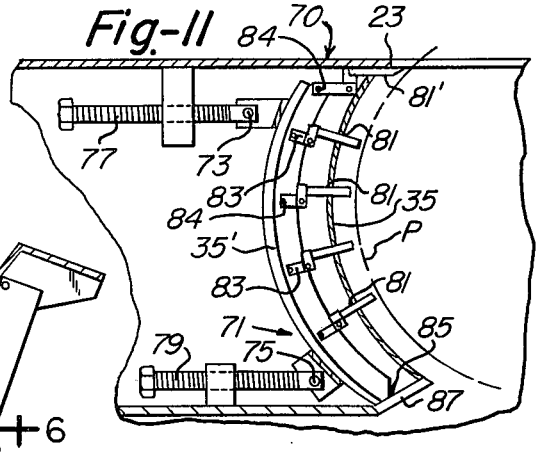
FIG. 2 is a view along line 2—2 of FIG. 1 illustrating the relative placement of the elements of the tub grinder.
Figure 2:
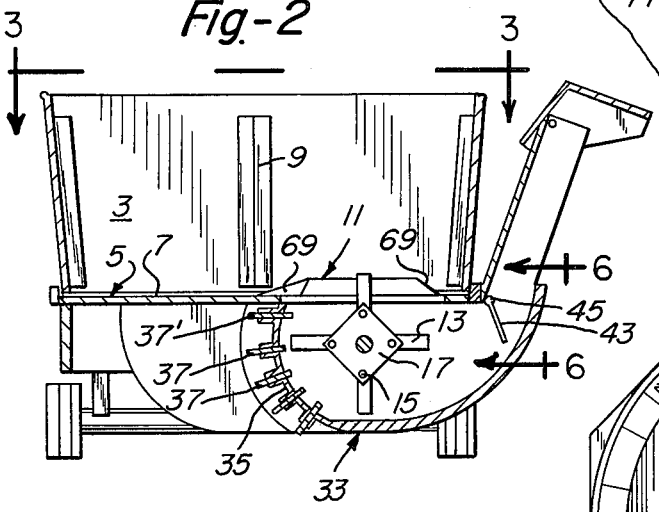
Figure 3:
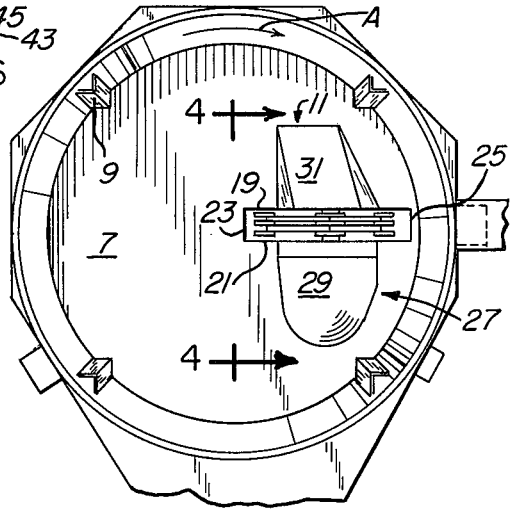
FIG. 3 is a view along line 3—3 of FIG. 2 illustrating the placement of the ramp member and stabilizer member in relation to the openings through the floor member and the axis of rotation of the hammermill.

As best seen in FIGS. 1-3, the tub grinder 1 has a substantially cylindrical tub member 3 and is mounted for rotation relative to the stationary floor member 5 in the direction of arrow A. The axis of rotation of the tub member 3 is substantially perpendicular to the flat, upper surface 7 of the floor member 5 and vanes 9 are mounted to the interior of the tub member 3 to assist in moving the material over the upper surface 7 of the floor member 5. As material moves over the upper surface 7 of the floor member 5, a portion of it moves up the ramp member 11 and into the path of the rotating hammers 13 as best seen in FIG. 4. The hammers 13 are pivotally mounted by pins 15 to the square support plates 17. Members 13, 15, and 17 form a hammermill which rotates about an axis located below the upper surface 7. The axis of the hammermill is substantially parallel to the upper surface 7 and a portion of the closed path P of the rotating hammers 13 extends through the opening defined by sides 19, 21, 23, and 25 in the floor member 5 and above the upper surface 7.

The stabilizer member 27 in the embodiments of FIGS. 1-4 has a curved upper surface 29 which is hood-shaped. The upper surface 29 of the stabilizer member 27 extends upwardly from a first location spaced from the side 21 of the opening in the upper surface 7 of floor member 5 to a second location substantially vertically above the side 21 as illustrated in FIG. 4. In like manner, the flat upper surface 31 of the ramp member 11 extends upwardly to a location substantially vertically above the side 19 of the opening in the floor member 5. In the preferred embodiments, the maximum height of the ramp member 11 above the upper surface 7 is less than the maximum height of the stabilizer member 27 which is less than the maximum height of the rotating hammers 13 above the upper surface 7. As illustrated in FIG. 4, the ramp member 11 and stabilizer member 27 are on opposite sids of the path of the rotating hammers 13 as well as being on opposite sides 19 and 21 across the opening in the floor member 5. As a bale of materials B or less compacted material is moved up the ramp member 11, a portion of it is planed away by the rotating hammers 13. The rotating tub member 3 will continue to advance the material and the material not planed off by the rotating hammers 13 coming to rest on the upper surface 29 of the stabilizer member 27. The bale or less compacted material continues to be advanced and a complete layer of it is planed off. If the material is in bales, the bale B goes around the floor member 5 and up the ramp member 11 again to have another layer planed off. If the material is less compacted or loose, the bottom layer of the material is continuously being planed off between the ramp member 11 and the stabilizer member 27.

Casing 33 encloses the rotating hammers 13 as best seen in FIG. 2. The material planed away by the rotating hammers 13 from above the upper surface 7 of the floor member 5 is moved about the axis of rotation of the hammers 13 past the wall member 35 of the casing 33. The wall member 35 has shear plates 37 mounted therein as best seen in FIG. 5. Each shear plate 37 is mounted between guides 39 and 41 and can be moved toward or away from the path P of the rotating hammers 13. The top shear plate 37' acts not only as a shear plate but also as a control means. Each shear plate 37 is flat and is movable in a plane that extends radially toward the axis of rotation of the hammers 13. The top shear plate 37' is mounted substantially horizontally and is located near the side 23 of the opening in the floor member 5. Shear plate 37' can be moved to control the amount of material passing from above the upper surface 7 of the floor member 5 down between the wall member 35 and the portion of the closed path P of the hammers 13 radially inward of the wall member 35 near the top end 42 of the wall member 35. The material is sheared as it passes between the hammers 13 and the shear plates 37 and 37'. In a preferred manner of operation, the shear plates 37 and 37' are moved progressively farther away from the closed path P of the rotating hammers 13 in the direction of rotation as illustrated in FIG. 5. The top shear plate 37' in the preferred embodiment is cut to form a blade at 38 to enhance its control and shearing characteristics.

Flap valve 43 in FIGS. 2 and 6 is positioned adjacent the material outlet of the casing 33. The flap valve 43 is mounted to bar 45 for pivotal movement between an open position and a closed position. Arm 47 extends from the pivot bar 45 exteriorly of the casing 33 to a position adjacent the bar 49 which is mounted to the exterior of the casing 33 as seen in FIG. 7. The flap valve 43 can be locked in any preferred position by unscrewing member 51, moving the arm 47, and screwing member 51 into any one of the plurality of holes 53 in the bar 49. Stops 55 extend outwardly at either end of the bar 49 to limit the swing of arm 49 about pivot bar 45. The holes 53 are positioned along a curved path and are more closely spaced together at the end of the path corresponding to the closing of the flap valve 43. By adjusting the flap valve 43, the amount of air discharged with the material out of the casing 33 through the material outlet can be controlled.

In the modification of FIGS. 8 and 9, the means for stabilizing the material consists of a main stabilizer member 57 and two, optional side stabilizer members 59. Each of these stabilizer members 57 and 59 has a vertical support member 61 and a member 63 which has an upper surface 65. The modification of FIGS. 8 and 9 can be operated with only the main stabilizer member 57 if desired, or with only one or both of the side stabilizer members 59. The preferred methods of operation are with the main stabilizer member 57 alone and with the main stabilizer member 57 in combination with both side stabilizer members 59. The stabilizer members 57 and 59 are removably attached by bolts 60 to the upper surface 7 of the floor member 5 and can be easily and quickly removed or replaced with larger or smaller stabilizer members. The ramp member 11 is also removably attached to the upper surface 7 of the floor member 5 so that it can also be removed or replaced with a larger or smaller ramp member. The size of the ramp member 11 determines the size of the layer planed off the material as it moves over the upper surface 7 of the floor member 5 and up the ramp member 11 into the path of the rotating hammers 13.

In the embodiment of FIG. 10, the means for stabilizing the material is shaped substantially like the ramp member 11', however, the stabilizer member 67 is preferably slightly higher than the ramp member 11'. As in the other embodiments, a layer of material is planed off as the material moves up the ramp 11' into the path of the rotating hammers 13. In all of the embodiments, the tub member 3 can be rotated in the opposite direction if necessary and the material will still be planed off although less efficiently than if the tub member 3 is rotated in the preferred direction indicated by arrow A in FIGS. 1 and 3. The embodiment of FIG. 10 is designed to enable the tub grinder 1 to operate relatively efficiently in either direction of rotation. The ramp member 11' in FIG. 10 has substantially straight walls 69', however, the preferred ramp members 11 of FIGS. 1–4, 8, and 9 have slanted sides 69 which extend outwardly to a position near sides 23 and 25 of the opening in the floor member 5.

In the embodiment of FIG. 11, the curved support member 35' can be moved toward and away from the wall member 35 of the casing and the axis of rotation of the hammers 13. The upper and lower ends 70 and 71 of the support member 35' are pivotally mounted at 73 and 75 respectively to screw members 77 and 79. The support member 35' can be moved as a unit toward and away from the wall member 35 and the rotational axis of the hammers 13 and each end 70 and 71 can be individually moved relative to the other end to allow for fine adjustment. The shear plates 81 and 81' are mounted on supports 83 which are pivotally mounted to the support member 35' at 84. The shear plates 81 and 81' extend through slots in the wall member 35 as illustrated in FIG. 11. As in the embodiment of FIG. 5, the shear plates 81 move substantially in planes that intersect the rotational axis of hammers 13 and the top shear plate 81' moves in a substantially horizontal plane. The top shear plate 81' of the embodiment in FIG. 11 also acts as a control means like shear plate 37' in the embodiment of FIG. 5. The lower end 71 of the wall member 35' has a notch 85 in it for slidably receiving the guide bar 87 which is supported in a stationary position relative to the wall member 35 and the rotational axis of hammers 13. The top end 70 can also be provided with a guide bar arrangement if desired.

In operation, material is placed in the tub grinder 1 and the tub member 3 is rotated to advance the material over the upper surface 7 of the floor member 5. Material is moved up ramp member 11 and into the path of the rotating hammers 13 where a layer of material is planed off. The material continues to advance and moves over the upper surface 29 of the stabilizer member 27. The material continues around the upper surface 7 of the floor member 5 and makes another pass up the ramp member 11 and into the path of rotating members 13 where another layer is planed off. The size of the bite or layer planed off the material can be easily and quickly adjusted by replacing the ramp member 11 with a larger or smaller one. Higher ramp members 11 are generally used for bales and lower ramp members 11 are generally used for loose material. Material can be in square bales, round bales, or loose stack and can be ear corn, shell corn, grain, or the like. The tub grinder 1 works well regardless of whether the material is wet or dry and the size of the ground material can be easily and quickly varied by moving the shear plates 37 and 37'. The modifications of FIGS. 8–11 are also designed to be operated in this manner.

The ramp members (11 and 11') and stabilizing means (27, 57, 59, and 67) of the various embodiments not only provide a tub grinder which has a substantially uniform feed into the casing 33 where the material is sheared but also a tub grinder which can be easily and quickly started up or stopped. When the tub grinder 1 is stopped or the control governor disengages the power to the rotating tub member 3 in response to an overload on the rotating hammers 13, any material including bales or loose material that is between the ramp member and the stabilizing means will be supported there almost intact and will not fall down by gravity into the casing 33 nor will it fall down and come to rest on top of the hammers 13. In past grinders, the material tended to fall down into the casing or fall down onto the hammers 33 when the grinder was stopped or slowed down by the governor. Consequently, in the past grinders, the hammermill often needed to be rewound or even cleaned out by hand before it could be restarted. In the present invention, the material is held substantially intact in the position it was in before the tub grinder 1 was stopped or slowed down and is ready for the rotating hammers to resume feeding it into the casing 33. Consequently, since the material does not fall into the casing 33 or come to rest on top of the hammers 13 when their rotational speed is reduced or stopped, the hammermill can be restarted or brought back up to peak rotational speed easily and quickly with the material still held intact in the position it was before the stop gauge for slowdown. In the preferred embodiments, the hammers 13 are pivotally mounted to the support plate 17, however, they can be rigidly secured thereto if desired.

While several emodiments of the present invention have been described in detail herein, various changes and modifications can be made without departing from the scope of the invention.

I CLAIM:

1. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening.

2. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said ramp member and said at least one stabilizer member being positioned on opposite sides of a plane extending substantially perpendicular to said second axis and on opposite sides of said first path portion of the closed path of said plurality of grinding elements.

3. In a tub grinder having a stationary floor member and a tub member mounted for rotation relative thereto about a first axis, said floor member having a upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side.

4. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said second side of said opening being substantially linear and said first direction being substantially perpendicular to said second side.

5. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said first direction being substantially coplanar with said second axis.

6. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvements including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said ramp member having an inclined upper surface extending upwardly from said upper surface of said floor member in a first direction from a first location spaced from the first side of said opening to a second location substantially vertically above said first side, said stabilizer member being spaced farther from said upper surface of said floor member at the respective second location than said ramp member at the respective second location.

7. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said ramp member having an inclined upper surface extending upwardly from said upper surface of said floor member in a first direction from a first location spaced from the first side of said opening to a second location substantially vertically above said first side, said stabilizer member being spaced farther from said upper surface of said floor member at the respective second location than said ramp member at the respective second location, said first and second sides of said opening being substantially parallel and each of said respective first directions of said ramp member and said at least one stabilizer member being substantially perpendicular to said first and second sides.

8. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said ramp member having an inclined upper surface extending upwardly from said upper surface of said floor member in a first direction from a first location spaced from the first side of said opening to a second location substantially vertically above said first side, said stabilizer member being spaced farther from said upper surface of said floor member at the respective second location than said ramp member at the respective second location, said first and second sides of said opening being substantially parallel and each of said respective first directions of said ramp member and said at least one stabilizer member being substantially perpendicular to said first and second sides, each of said respective first directions being substantially coplanar with said second axis.

9. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said ramp member having inclined upper surface extending upwardly from said upper surface of said floor member in a first direction from a first location spaced from the first side of said opening to a second location substantially vertically above said first side, said stabilizer member being spaced farther from said upper surface of said floor member at the respective second location than said ramp member at the respective second location, said first path portion of said plurality of grinding elements entending farther above said upper surface of said floor member than said at least one stabilizer member at the respective second location.

10. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said stabilizer means including a second stabilizer member having an inclined upper surface, said inclined upper surface of said second stabilizer member extending upwardly from said upper surface of said floor member in a first direction from a first location spaced from the second side of said opening to a second location substantially vertically above said second side, said respective first directions of said at least one stabilizer member and said second stabilizer member being substantially parallel.

11. The tub grinder of claim 10 wherein said stabilizer means includes a third stabilizer member having an inclined upper surface, said inclined top surface of said third stabilizer member extending upwardly from said upper surface of said floor member in a first direction from a first location spaced from the second side of said opening to a second location substantially vertically above said second side, said respective first directions of at least one stabilizer member, said second stabilizer member, and said third stabilizer member being substantially parallel to each other.

12. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface said inclined upper surface extending upwardly from said upper surface of said floor member in a first direction from a first location spaced from the second side of said opening to a second location substantially vertically above said second side, said inclined upper surface being curved and extending downwardly toward said upper surface of said floor member from said second location to said first location, said inclined, curved upper surface further extending downwardly toward said upper surface of said floor member from said second location in a direction substantially perpendicular to said first direction.

13. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said inclined upper surface being curved and extending downwardly toward said upper surface of said floor member from said second location to said first location, said inclined, curved upper surface further extending downwardly toward said upper surface of said floor member from said second location in a direction substantially perpendicular to said first direction, said inclined upper surface being substantially hood-shaped.

14. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said inclined upper surface of said at least one stabilizer member being curved and said ramp member having an inclined upper surface extending upwardly from said upper surface of said floor member in a first direction from a first location spaced from the first side of said opening to a second location substantially immediately above said first side, said inclined upper surface of said ramp member being substantially flat.

15. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, said at least one stabilizer member having an inclined upper surface, said inclined upper surface extending upwardly from said upper surface of said floor member in a first direction from a first location spaced from the second side of said opening to a second location substantially vertically above said second side, said inclined upper surface of said at least one stabilizer member being substantially flat and said ramp member having an inclined upper surface extending upwardly from said upper surface of said floor member in a first direction from a first location spaced from the first side of said opening to a second location substantially immediately above said first side, inclined upper surface of said ramp member being substantially flat.

16. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, and, said grinding means includes a support means extending outwardly of said second axis and means for mounting said plurality of grinding elements to said support means, said grinding means further including a casing member substantially enclosing said support means and said grinding elements, said casing member having a wall member spaced radially outward of a second portion of said closed path of said plurality of grinding elements, said casing member further including means for shearing material, said shearing means including a plurality of shear plates and means for mounting said shear plates for movement relative to said wall member, each of said shear plates being substantially flat and movable in a respective plane toward and away from said second path portion of said closed path whereby any material moved into the first portion of said closed path of said plurality of grinding elements is moved by said plurality of grinding elements past said shear plates where said material is sheared between said plurality of grinding elements and said shear plates.

17. The tub grinder of claim 16 wherein each respective plane of said plurality of shear plates is directed toward said second axis.

18. The tub grinder of claim 16 wherein said wall member extends radially about said second path portion from a first location near said floor member adjacent a third side of said opening, said tub grinder further including means for selectively controlling the amount of material passing from above said upper surface of said floor member down between said second path portion and said wall member at said first location.

19. The tub grinder of claim 18 wherein said controlling means is one of said shear plates, said controlling shear plate being mounted to said wall member adjacent said first location and said plane of movement of said controlling shear plate being substantially parallel to said third side of said opening.

20. The tub grinder of claim 19 wherein said controlling shear plate has an edge portion nearest said second path portion, said edge portion forming a blade for enhancing the controlling and shearing properties of said controlling shear blade.

21. The tub grinder of claim 16 wherein said means for movably mounting said shear plates includes a support member spaced outwardly of said wall member from said second path portion, said wall member having a plurality of slots therethrough for slidably receiving each respective shear plate, said means for movably mounting said shear plates further including means for mounting said support member for movement as a unit relative to said second axis.

22. The tub grinder of claim 21 further including means for pivotally mounting at least one of said shear plates to said support member.

23. The tub grinder of claim 21 wherein said support member for said shear plates has a first and second end and said mounting means for said support member includes means for moving each respective end of said support member relative to the other end.

24. The tub grinder of claim 23 wherein each of said moving means includes a threaded screw member.

25. The tub grinder of claim 23 wherein at least one end of said support member is notched, said tub grinder further including a guide member and means to support said guide member in a stationary position relative to said second axis, a portion of said guide member being slidably receivable within said notch to guide said support member during movement relative to said second axis.

26. The tub grinder of claim 16 wherein said means for mounting said grinding elements to said support means includes means for pivotally mounting each of said grinding elements to said support means.

27. In a tub grinder having a stationary floor member and a tub member mounted for rotation relative thereto about a first axis, said floor member having an upper surface with an opening therethrough and said tub member being mounted with at least a portion thereof extending above said upper surface of the floor member and with said first axis of rotation substantially perpendicular to said upper surface, said tub grinder further having a ramp member mounted on and extending above said upper surface of said floor member adjacent one side of the opening therethrough and a grinding means mounted for rotation about a second axis, said second axis being located below said upper surface of the floor member, said grinding means having a plurality of grinding elements, said grinding elements moving along a closed path as said grinding means is rotated about said second axis, a first portion of said closed path extending through said opening in said floor member and above said upper surface whereby material on said floor member within said rotating tub member is moved over the upper surface of said floor member and part of the material is moved up said ramp member into said first path portion of the closed path of said plurality of grinding elements, the improvement including:

means for stabilizing the moving material near said opening, said stabilizing means including at least one stabilizer member and means for mounting said at least one stabilizer member on said upper surface of said floor member adjacent a second side of said opening with said at least one stabilizer member extending above the upper surface of said floor member, said first and second sides of said opening being substantially opposite each other across said opening, and, a casing member substantially enclosing said plurality of grinding elements, said casing member having an outlet spaced about said closed path of said grinding elements from said opening through said floor member in the direction of rotation of said grinding means, said tub grinder further including means for selectively controlling the size of said outlet opening, said control means including a flat valve and means for pivotally mounting said flap valve to said casing member, said control means further including means for selectively locking said flap valve in a preferred position relative to said casing member, said locking means including a bar member mounted to said casing member exteriorly of said grinding elements, said control means having an arm operably connected to said flap valve extending exteriorly of said casing member adjacent said bar member, said locking means including means for selectively attaching said arm member to said bar member at any one of a plurality of locations along said bar member whereby the size of the outlet can be enlarged or decreased.

28. The tub grinder of claim 27 wherein said flap valve extends downwardly from said pivotal axis and is movable between an open position and a closed position to selectively control the amount of air passing out of the casing member through said outlet with the material.

29. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member.

30. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being position therebelow adjacent the opening through said upper surface, said grinding element extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member, said stabilizer member and said ramp member being positioned on opposite sides of a plane extending substantially perpendicular to said second axis and on opposite sides of said first path portion of the closed path of said plurality of grinding elements.

31. A rotary tub grinder comprising;

a floor member having a substantially planar upper surface with an opening passing therethrough.

a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent and second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member, said stabilizer member having an inclined upper surface, said inclined upper surface extending upwardly from said upper surface of said floor member in a first direction from a first location spaced from the second side of said opening to a second location substantially vertically above said second side.

32. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member, said stabilizer member having an inclined upper surface, said inclined upper surface extending upwardly from said upper surface of said floor member in a first direction from a first location spaced from the second side of said opening to a second location substantially vertically above said second side, said ramp member having an inclined upper surface extending upwardly from said upper surface of said floor member in a first direction from a first location spaced from the first side of said opening to a second location substantially vertically above said first side, said stabilizer member being spaced farther from said upper surface of said floor member at the respective second location than said ramp member at the respective second location.

33. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and towards said stabilizer member, said stabilizer member having an inclined upper surface, said inclinded upper surface extending upwardly from said upper surface of said floor member in a direction from a first location spaced from the second side of said opening to a second location substantially vertically above said second side, said ramp member having an inclined upper surface extending upwardly from said upper surface to said floor member in a first direction from a first location spaced from the first side of said opening to a second location substantially vertically above said first side, said stabilizer member being spaced farther from said upper surface of said floor member at the respective second location than said ramp member at the respective second location, said first path portion of said plurality of grinding elements extending farther above said upper surface of said floor member than said stabilizer member at the respective second location.

34. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member, said stabilizer member having an inclined upper surface, said inclined upper surface extending upwardly from said upper surface of said floor member in a first direction from a first location spaced from the second side of said opening to a second location substantially vertically above said second side, said inclined upper surface of said stabilizer member being curved and said inclined upper surface of said ramp member being flat.

35. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shorter distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer means on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grindig elements and toward said stabilizer member, said stabilizer member having an inclined upper surface, said inclined upper surface extending upwardly from said upper surface of said floor member in a first direction from a first location spaced from the second side of said opening to a second location substantially vertically above said second side, the inclined upper surface of said stabilizer member being curved.

36. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, said grinding means includes a support means extending outwardly of said second axis and means for mounting said plurality of grinding elements to said support means, said grinding means further including a casing member substantially enclosing said support means and said grinding elements, said casing member having a wall member spaced radially outward of a second portion of said closed path of said plurality of grinding elements, said casing member further including means for shearing material, said shearing means including a plurality of shear plates and means for mounting said shear plates for movement relative to said wall member, each of said shear plates being substantially flat and movable in a respective plane toward and away from said second path portion of said closed path whereby any material moved into the first portion of said closed path of said plurality of grinding elements is moved by said plurality of grinding elements past said shear plates where said material is sheared between said plurality of grinding elements and said shear plates, a ramp member and means for mounting said ramp member on said upper surface of said floor member adjacent a first side of said openings, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member.

37. The tub grinder of claim 36 wherein each respective plane of said plurality of said shear plates is directed toward said second axis.

38. The tub grinder of claim 36 wherein said wall member extends radially about said second path portion from a first location near said floor member adjacent a third side of said opening, said tub grinder further including means for selectively controlling the amount of material passing from above said upper surface of said floor member down between said second path portion and said wall member at said first location.

39. The tub grinder of claim 38 wherein said controlling means is one of said shear plates, said controlling shear plate being mounted to said wall member adjacent said first location and said plane of movement of said controlling shear plate being substantially parallel to said third gate of said opening.

40. The tub grinder of claim 39 wherein said controlling shear plate has an edge portion nearest said second path portion, said edge portion forming a blade for enhancing the controlling and shearing properties of said controlling shear plate.

41. The tub grinder of claim 36 wherein said means for movably mounting said shear plates include a support member spaced outwardly of said wall member from said second path portion, said wall member having a plurality of slots therethrough for slidably receiving each respective shear plate, said means for movably mounting said shear plates further including means for mounting said support member for movement as a unit relative to said second axis.

42. The tub grinder of claim 41 further including means for pivotally mounting at least one of said shear plates to said support member.

43. The tub grinder of claim 41 wherein said support member for said shear plates has a first and second end, and said mounting means for said support member includes means for moving each respective end of said support member relative to the other end.

44. The tub grinder of claim 43 wherein each of said moving means includes a threaded screw member.

45. The tub grinder of claim 43 wherein at least one end of said support member is notched, said tub grinder further including a guide member and means to support said guide member in a stationary position relative to said second axis, a portion of said guide member being slidably receivable with said notch to guide said support member during movement relative to said second axis.

46. The tub grinder of claim 36 wherein said means for mounting said grinding elements to said support means includes means for pivotally mounting each of said grinding elements to said support means.

47. A rotary tub grinder comprising:

a floor member having a substantially planar upper surface with an opening passing therethrough, a tub member, means for mounting said tub member adjacent said floor member for a rotation relative thereto about a first axis, said first axis being substantially perpendicular to said upper surface of said floor member, grinding means, said grinding means including a plurality of grinding elements and means for mounting said grinding elements for rotation about a second axis, said second axis being substantially parallel to said upper surface of said floor member and being positioned therebelow adjacent the opening through said upper surface, said grinding elements extending outwardly of said second axis for a distance greater than the shortest distance between said second axis and said upper surface when said grinding means is rotating whereby said grinding elements are moved along a closed path, a first portion of said closed path extending through said opening and above said upper surface, a ramp member and means for mounting said ramp member on said upper surface of said floor member adjacent a first side of said opening, a stabilizer member and means for mounting said stabilizer member on said upper surface of said floor member adjacent a second side of said opening, said first and second sides of said opening being substantially opposite each other across said opening, whereby rotation of said tub member moves material over said upper surface of said floor member and up said ramp member into said first path portion of the closed path of said plurality of grinding elements and toward said stabilizer member, and, a casing member substantially enclosing said plurality of grinding elements, said casing member having an outlet spaced about said closed path of said grinding elements from said opening through said floor member in the direction of rotation of said grinding means, said tub grinder further including means for selectively controlling the size of said outlet opening, said control means including a flap valve and means for pivotally mounting said flap valve to said casing member, said control means further including means for selectively locking said flap valve in a preferred position relative to said casing member, said locking means including a bar member mounted to said casing member exteriorly of said grinding elements, said control means having an arm operably connected to said flap valve and extending exteriorly of said casing member adjacent said bar member, said locking means including means for selectively attaching said arm member to said bar member at any one of a plurality of locations along said bar member whereby the size of the outlet can be enlarged or decreased.

48. The tub grinder of claim 47 wherein said flap valve extends downwardly from said pivotal axis and is movable between an open position and a closed position to selectively control the amount of air passing out of the casing member through said outlet with the material.

* * * * *